US006684504B2

(12) United States Patent
Sullivan et al.

(10) Patent No.: US 6,684,504 B2
(45) Date of Patent: Feb. 3, 2004

(54) METHOD OF MANUFACTURING AN IMAGEABLE SUPPORT MATRIX FOR PRINTHEAD NOZZLE PLATES

(75) Inventors: Carl Edmond Sullivan, Stamping Ground, KY (US); Herbert Gordon Toews, III, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/829,158

(22) Filed: Apr. 9, 2001

(65) Prior Publication Data

US 2002/0145646 A1 Oct. 10, 2002

(51) Int. Cl.[7] ..... B21D 53/76

(52) U.S. Cl. ..... 29/890.1; 29/DIG. 16; 347/45; 347/47; 347/65; 430/320

(58) Field of Search ..... 29/890.1, 611, 29/25.35, 830, DIG. 16; 347/54, 65, 45, 47; 430/320, 312, 313; 219/121.68, 121.69

(56) References Cited

U.S. PATENT DOCUMENTS

| | | | | |
|---|---|---|---|---|
| 4,059,480 | A | | 11/1977 | Ruh et al. |
| 4,246,076 | A | | 1/1981 | Gardner |
| 4,312,009 | A | | 1/1982 | Lange |
| 4,528,070 | A | | 7/1985 | Gamblin |
| 4,558,333 | A | | 12/1985 | Sugitani et al. |
| 4,611,219 | A | | 9/1986 | Sugitani et al. |
| 4,727,012 | A | | 2/1988 | Quella et al. |
| 4,770,740 | A | | 9/1988 | Tsuzuki et al. |
| 4,789,425 | A | | 12/1988 | Drake et al. |
| 4,827,287 | A | | 5/1989 | Braun et al. |
| 5,016,024 | A | | 5/1991 | Lam et al. |
| 5,057,853 | A | | 10/1991 | Fisher |
| 5,068,006 | A | | 11/1991 | Fisher |
| 5,229,785 | A | | 7/1993 | Leban |
| 5,305,018 | A | | 4/1994 | Schantz et al. |
| 5,331,344 | A | * | 7/1994 | Miyagawa et al. ..... 347/65 X |
| 5,334,999 | A | | 8/1994 | Kashiwazaki et al. |
| 5,350,616 | A | | 9/1994 | Pan et al. |

(List continued on next page.)

FOREIGN PATENT DOCUMENTS

| | | | |
|---|---|---|---|
| EP | 0 627 318 A1 | | 12/1994 |
| JP | 6-294903 | * | 10/1994 |

OTHER PUBLICATIONS

Sasage et al, New High Transparent Resist and Process Technology for KrF Excimer Laser Lithography, Electron Devices Meeting, 1988, Technical Digest, International, Dec. 1988, INSPEC Accession No. 3380260, pp. 88–91.*

Bagen et al. Next Generation Coating Technologies for Low–Cost Electronics Manufacturing, Electronics Manufacturing Technology Symposium, 1996, Nineteenth IEEE/CMPT, Oct. 1996, INSPEC Accession No. 5495948, pp. 468–475.*

*Primary Examiner*—A. Dexter Tugbang
(74) *Attorney, Agent, or Firm*—Taylor & Aust, P.C.

(57) ABSTRACT

An imageable support matrix for printhead nozzle plates and a method for manufacturing the printhead. The ink jet printhead comprises a substrate including an ink via therein; a first layer of imageable material, the first layer of imageable material having ink conducting voids therein and defining support structures adjacent the ink via; and a second layer of imageable material disposed on the first layer of imageable material, the second layer of imageable material including ink jet nozzles therein. The method includes providing a substrate; applying a first layer of imageable material on the substrate; masking the applied first layer of imageable material; and developing the masked first layer of imageable material to provide ink conducting voids in the first layer of imageable material and hardened areas of support. The method further includes creating an ink via in the substrate; applying a second layer of imageable material on the first layer of imageable material; and forming nozzles in the second layer of imageable material.

11 Claims, 4 Drawing Sheets

U.S. PATENT DOCUMENTS 5,365,643 A 11/1994 Fujimoto
5,375,326 A * 12/1994 Usui et al. ..... 29/890.1
5,443,713 A 8/1995 Hindman
5,524,784 A 6/1996 Shiba et al.
5,560,837 A 10/1996 Trueba
5,686,224 A * 11/1997 O'Neill ..... 430/320
5,719,805 A 2/1998 Masuoka
5,738,799 A 4/1998 Hawkins et al.
5,763,141 A 6/1998 Shimomura et al.
5,766,441 A 6/1998 Arndt et al.
5,808,644 A 9/1998 Imamura et al.
5,820,771 A 10/1998 Burke et al.
5,821,959 A 10/1998 Murakami et al.
5,900,892 A 5/1999 Mantell et al.
5,915,763 A 6/1999 Masuda
6,045,214 A * 4/2000 Murthy et al. ..... 347/65 X

* cited by examiner

METHOD OF MANUFACTURING AN IMAGEABLE SUPPORT MATRIX FOR PRINTHEAD NOZZLE PLATES

BACKGROUND OF THE INVENTION

1. Field of the invention

The present invention relates to ink jet printheads manufactured with photoimageable layers, and more particularly to a support structure for the nozzle plate of an ink jet printer printhead, particularly useful for high-resolution printheads, and the method for manufacturing the structure.

2. Description of the Related Art

Ink jet printers are in wide use due to their low cost of operation, low energy use and quiet operating features. Ink jet printing involves ejection of tiny ink droplets through small nozzles in a controlled manner to create the desired image. Ink is supplied from an ink reservoir to a printing head, which includes various passageways from the reservoir to the nozzle orifice. Energy is applied to the ink from an ink droplet generator near each orifice, which may include the application of electrostatic attraction, the application of oscillating forces from piezo elements, the application of heat from heating elements or the like.

For creating a high print quality, the ink droplets reaching the receiving media should be of consistent volume and shape, and should strike the receiving media at a known angle to impart a pixel of desired size and shape on the media. To control the characteristics of the ink droplets ejected onto the receiving media, such as the size and shape of the ink droplet and the trajectory of the droplet towards the media, a nozzle plate is provided over the underlying printhead structure. The underlying structure defines various ink conducting voids in the material layers, such as ink vias, ink channels and firing chambers. Ink vias are larger volume ink flow paths supplying ink from a reservoir to a number of ink supply channels. The ink supply channels direct ink to the individual firing chambers beneath each of the nozzles. The ink droplet generator acts on the ink in the firing chamber, causing the ink to be ejected from the nozzle. By selectively activating individual ink droplet generators, the desired pattern of ink can be applied to the receiving surface, such as a sheet of paper, to create the desired image, which may be a letter, number, symbol, part of a picture or the like. The growing demand for high quality color printing places even greater demands on the precision of pixel deposition on the receiving surface.

In a known method for creating a printhead, laser ablation is used to form the ink channels, firing chambers and nozzles in a nozzle plate. Grit blasting is used to create an ink via in a heater chip. The nozzle plate is then applied to the heater chip. If properly aligned, a firing chamber is disposed directly beneath each nozzle, and ink channels receive ink from the ink via, and supply ink to each firing chamber. Accurately positioning the nozzles over the underlying structure can present manufacturing challenges, and improperly positioned nozzles can result in printing deficiencies.

U.S. Pat. No. 6,045,214 entitled "Ink Jet Printer Nozzle Plate Having Improved Flow Feature Design And Method Of Making Nozzle Plates" discloses a nozzle plate and a method for making a nozzle plate which includes laser ablating ink flow channels, firing chambers, nozzle holes and ink supply regions in a polymeric film made of a polymeric material layer, an adhesive layer and a protective layer. The protective layer is removed, and the nozzle plate is attached to a semiconductor substrate using the adhesive layer.

Recent improvements in the resolution of images created by ink jet printers have been widely appreciated by users of the printers, but have created additional manufacturing difficulties for printer suppliers. Resolution in the printer art may be defined as the number of ink droplets or "dots" which can be generated in one square inch of printing field. Thus, a resolution of 600 dpi (dots per inch) requires the capability of ejecting 600 droplets of ink in a one square inch area. Higher resolution, i.e. a greater number of smaller ink droplets per area, results in a more clear print, with finer, more defined lines. Again, the demand for better color printing capabilities has driven the need for higher resolution printheads Each nozzle opening defines a single ink droplet. Higher resolution requires not only a higher concentration of nozzles in the nozzle plate, but also a higher concentration of firing chambers, ink channels, ink vias and the like in the structure underlying the nozzle plate. With the increased nozzle concentration required for higher resolution printers, and the need for an increased number of associated underlying firing chambers, ink channels and ink vias, the manufacture of nozzle plates has become more complex and difficult.

In a more recently developed, preferred method for making a printhead, the ink via in the heater chip is created by a grit blast process, and the nozzle plate is made in two thin, superimposed layers. First and second photo imageable layers are provided, with ink channels and firing chambers created in the first layer, and the ink nozzles created in the second layer. The photo imageable layers may be manufactured by processes that include the use of positive or negative photoresist materials, with a suitable photomask applied thereto, and subsequent exposure and development of the photoresist layer. Depending upon the selection of materials and the type of photoresist used (positive or negative), a positive or negative photomask is used, and the exposure and development process hardens either the masked or unmasked areas. Subsequent processing in a chemical bath dissolves the unhardened material, creating the desired ink conducting void or nozzle in the layer.

Precisely located ink channels, firing chambers and nozzles can be made utilizing this method. Using a multilayer structure having first and second photo imageable layers results in a better heater to nozzle alignment accuracy than in early methods of placing a laser ablated polyimide nozzle plate onto a grit blasted heater chip. Nozzle plate assemblies manufactured using photoimagable layers are also desirably thin. However, due to the extremely thin nature of the nozzle plate or second layer, and the lack of supporting structure beneath the nozzle plate in the first layer containing the various ink conducting voids, especially in printheads for higher resolution printers, there is a tendency for the second imageable layer to cave in over the ink via, as a result of the large span from one side of the underlying cavity to the other side thereof.

Therefore, what is needed is a support matrix for the nozzle plate of a photoimageable printhead for an ink jet printer, and a manufacturing process to create the printhead.

SUMMARY OF THE INVENTION

The present invention provides an imageable support matrix for an ink jet printhead, and a manufacturing method therefor, which provides increased areas of support beneath the printhead nozzle plate, and is particularly useful for printheads in higher resolution printers. support beneath the printhead nozzle plate, and is particularly useful for printheads in higher resolution printers.

The invention comprises, in one form thereof, a method of forming an ink jet printhead comprising providing a substrate; applying a first layer of imageable material on the substrate; masking the applied first layer of imageable material; developing the masked first layer of imageable material to provide ink conducting voids in the first layer of imageable material and hardened areas of support; creating an ink via in the substrate by removing material from the substrate and from the first layer of imageable material; applying a second layer of imageable material on the first layer of imageable material; and forming nozzles in the second layer of imageable material.

The invention comprises, in another form thereof, a method of forming an ink jet printhead comprising providing a substrate; creating an ink via in the substrate by removing material from the substrate; applying a first layer of imageable material on the substrate, including applying the imageable material over the ink via; masking the applied first layer of imageable material; developing the first layer of imageable material to provide ink conducting voids in the first layer of imageable material and openings through the imageable material communicating with the ink via; applying a second layer of imageable material on the first layer of imageable material; and forming nozzles in the second layer of imageable material.

The invention comprises, in yet another form thereof, a method of forming an ink jet printhead comprising providing a substrate; creating an ink via through the substrate; providing a first layer of imageable material; developing the first layer of imageable material to create ink conducting voids and support structures up to the ink via; and providing a second layer of imageable material on the first layer of imageable material, said second layer of imageable material including nozzles therein.

The invention comprises, in a further form thereof, an ink jet printhead comprising; a substrate including an ink via therein; a first layer of imageable material, the first layer of imageable material having ink conducting voids therein and defining support structures adjacent the ink via; and a second layer of imageable material disposed on the first layer of imageable material, the second layer of imageable material including ink jet nozzles therein.

The invention comprises, in still another form thereof an ink jet printhead comprising a substrate having an ink via; a first layer of imageable material defining ink conducting voids therein, and including support structures adjacent the ink via; and a second layer of imageable material supported by the first layer of imageable material and having nozzles therein. The ink jet printhead is manufactured by applying the first layer of imageable material on the substrate; creating in the first layer of imageable material ink conducting voids; removing material from the substrate and from the first layer of imageable material to create the ink via; applying the second layer of imageable material on the first layer of imageable material; and developing the second layer of imageable material to create the nozzles.

The invention comprises, in a still further form thereof an ink jet printhead comprising a substrate having an ink via; a first layer of imageable material defining ink conducting voids therein, and including support structures adjacent the ink via; and a second layer of imageable material supported by the first layer of imageable material and having nozzles therein; the ink jet printhead manufactured by; creating an ink via in the substrate; applying the first layer of imageable material over the substrate and the ink via in the substrate; masking the first layer of imageable material; developing the first layer of imageable material to define the ink conducting voids, the support structures and an opening to the ink via; applying the second layer of imageable material over the first layer of imageable material; and developing the second layer of imageable material to create the nozzles.

An advantage of the present invention is providing a high-resolution printhead less prone to nozzle plate collapse than previously known structures.

Another advantage is providing a manufacturing method for a high-resolution printhead, which utilizes known techniques and materials in a way to increase nozzle plate support in the completed printhead.

A further advantage of the present invention is reducing the length of unsupported, open spans beneath the nozzle plate layer of a multi-layer printhead, and providing nozzle plate support structures adjacent and/or spanning the ink via opening beneath the nozzle plate.

BRIEF DESCRIPTION OF THE DRAWINGS

The above-mentioned and other features and advantages of this invention, and the manner of attaining them, will become more apparent and the invention will be better understood by reference to the following description of embodiments of the invention, taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
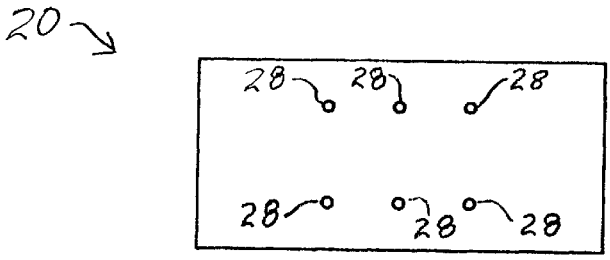
FIG. 1 is a top plan view of a nozzle plate for a printhead of the present invention.

Referring now to the drawings, and particularly to FIG. 1, there is shown a printhead structure 20 of the present invention, suitable for use in an ink jet printer. As seen in the side elevational view of FIG. 2, printhead structure 20 includes a semiconductor substrate 22, and first and second layers 24 and 26, respectively, of imageable material such as, for example, photoresist. Second layer 26 is provided with a plurality of nozzles 28 (FIG. 1) therein.

Substrate 22 is an Integrated Circuit (IC) chip, commonly known in the industry, and includes electrical components such as resistors and active circuits forming heating elements, not shown, connected to circuitry, also not shown, for the operation thereof. The IC chip may include, instead of heating elements for heating ink, one or more piezo elements oscillated to transfer energy to small quantities of ink in order to generate the necessary jetting pressure required to induce the ejection of ink droplets from nozzles 28. The operation of a printhead, as thus far described, is known to those skilled in the art, and will not be described in greater detail herein.

Figure 3:
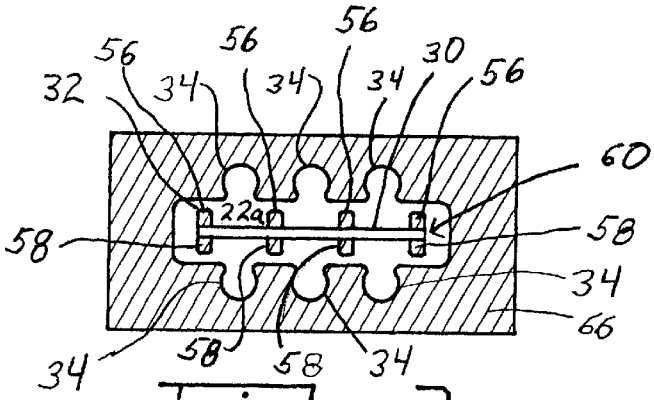
FIG. 3 is a plan view of the printhead structure shown in FIGS. 1 and 2, but showing the printhead with the nozzle plate layer removed, the figure being taken along line 3—3 of FIG. 2.

The IC chip substrate is commonly silicon, and may be manufactured by any of the known methods, which will not be described in further detail herein. Referring now to FIG. 3, which is essentially a view of printhead 20 having second layer 26 removed to reveal a plan view of first layer 24, substrate 22 includes one or more ink via 30, visible in FIG. 3 through openings in first layer 24. Ink via 30 extends through substrate 22 to allow the passing of ink from an ink reservoir, not shown, behind the chip into one or more ink passage area 32 and firing chamber 34 defined by first layer 24. The one or more ink passage area 32 and firing chambers 34 are provided as voids or openings in first layer 24, created therein in a manner and by a process to be described subsequently herein. Surfaces 22*a* and 26*a* of substrate 22 and second layer 26, respectively, sandwich first layer 24 therebetween.

Figure 2:
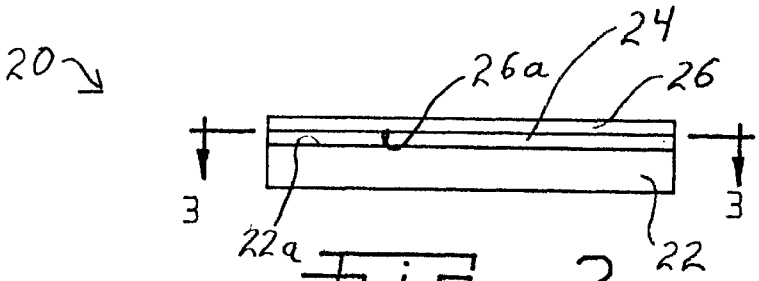
FIG. 2 is a side elevational view of the nozzle plate and underlying layers in the printer head shown in FIG. 1.
Figure 4:
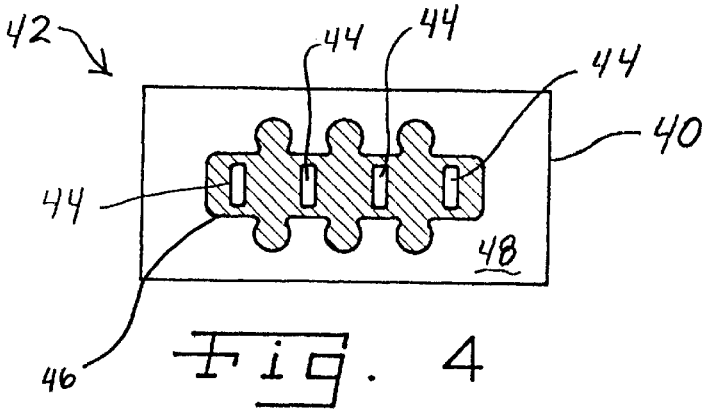
FIG. 4 is a plan view of a photoresist photomask used in creating the layer shown in FIG. 3.

The manufacturing method for printhead structure 20 shown in FIGS. 1–3 will now be explained with reference to FIG. 4, and subsequent figures. FIG. 4 illustrates an early step in the manufacturing process. Substrate 22 is not visible, having been covered by a first layer of imageable material. As illustrated in FIG. 4, the as yet unprocessed, but applied imageable material layer is indicated by numeral 40, and is presumed to be a photoresist material, although other imageable materials also may be used. Numeral 40 shall be used to designate unprocessed imageable material throughout the various drawings. A photomask 42 is shown applied over the unprocessed layer 40. As seen in FIG. 4, photomask 42 also includes four openings 44 therein, through which the underlying unprocessed layer 40 is exposed. It should be understood that photomask 42 may not have "openings" in the common sense of the word, but may, instead, have opaque and transparent regions. In the use of photoresist materials, a light source is used to establish differing physical properties between the exposed and unexposed areas of photoresist material. Therefore, transparent areas can be used rather than actual openings in photomask 42. The opaque area of photomask 42 has been designated with the numeral 46 in FIG. 4, and is indicated with cross-hatching. An area 48 outwardly of opaque area 46 is translucent.

Unprocessed layer 40 may be a material commonly referred to as a "negative photoresist" material. Known negative photoresist materials have physical properties, such as solubility, that can be altered by exposure to a light source. Exposure to light causes the photoresist, which was soluble in a particular solvent before exposure, to become insoluble in the same solvent after exposure. During processing of the negative photoresist material, photomask 42 covers regions of unprocessed photoresist layer 40 which will become various ink conducting voids, including ink cavities, channels, heater chambers and the like. The regions of photoresist layer 40 that are not covered will become support areas for second layer 26. In using a negative photoresist material, following subsequent processing, areas that are not photomasked, and therefore are exposed, undergo a chemical reaction, such as polymerization, and are hardened or made insoluble. Areas that are photomasked are unchanged during initial processing, and thereby remain soluble in the appropriate solvent.

Figure 5:
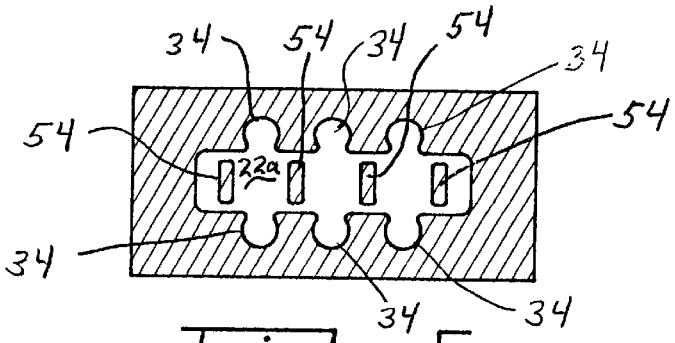
FIG. 5 is a plan view similar to that shown in FIG. 3, but illustrating the appearance at one stage of the manufacturing process.

Substrate 22, with unprocessed layer 40 and photomask 42 thereon, is subjected to a conventional negative photoresist processing procedure. The process is often referred to as "developing" the photoresist, and includes exposure to the appropriate photoresist activating energy source, which may be a light source, with the resultant effect of hardening, polymerizing or solidifying the exposed areas of photoresist material. Thereafter, photomask 42 is removed, and conventional subsequent processing of the activated photoresist layer may include immersion in a suitable organic solvent. The solvent dissolves and removes the unactivated regions of photoresist material, essentially those regions that were covered by photomask 42, while leaving the activated areas that were exposed to the light source. Development may include further activation of the remaining photoresist through further polymerization caused by heat or additional exposure of the remaining photoresist. The structure following the development process is shown in FIG. 5, wherein the underlying surface 22*a* of substrate 22 is visible through the now processed first layer 24. First layer 24 includes the regions illustrated by cross-hatching in FIG. 5, which is a view similar to FIG. 3, but illustrating an intermediate step in the manufacturing process. First layer 24 has some thickness above surface 22*a* of substrate 22, and includes the outer peripheral region which defines firing chambers 34 and ink passage areas 32, and includes four inner support pedestals 54 corresponding to openings 44 in photomask 42.

After complete formation of first layer 24, elongated ink via 30 is created in substrate 22 by grit blasting or the like. Cutting ink via 30 through substrate 22 after application and processing of first layer 24 results in also cutting through four support pedestals 54, leaving pedestal segments 56 and 58 of each pedestal 54 immediately adjacent via 30, on opposite sides thereof. Pedestal segments 56 and 58 are separated from each other by the width of via 30, and provide a support matrix 60 supplying support for second layer 26 to be applied subsequently.

Figure 14:
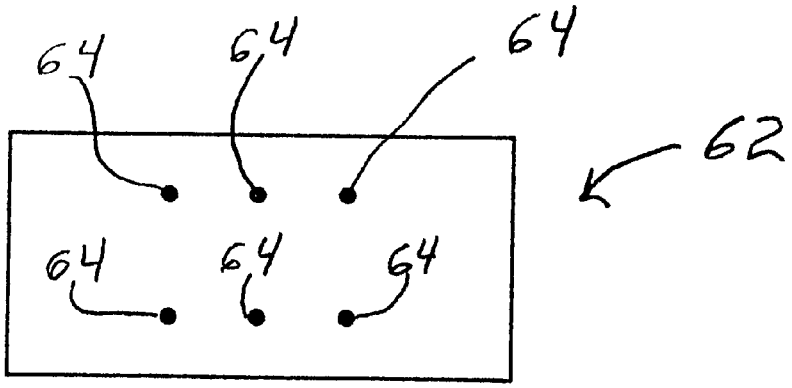
FIG. 14 is a plan view of a photomask used for making the nozzle plate shown in FIG. 1.

After complete formation of ink via 30, the structure will appear essentially as shown in FIG. 3. Thereafter, second layer 26 of imageable material is laminated on top of first layer 24. In known manner, a photoresist or photoimageable layer is applied on top of first layer 24, and a photomask is applied to the unprocessed second layer. FIG. 14 illustrates a photomask 62 suitable for the arrangement of nozzles 28 shown in FIG. 1. Photomask 62 is mostly translucent, having only opaque areas 64 corresponding to the desired size of nozzles 28 in the locations where nozzles 28 are to be provided. Care must be taken in positioning photomask 62, and in defining the locations for nozzles 28, so that a nozzle 28 is provided in proper alignment above each heating or firing chamber 34. Subsequent development and processing of second layer 26 removes unhardened material, resulting in the formation of second layer 26 having nozzles 28. The development of second layer 26 of imageable material may be the same as that described for unprocessed imageable layer 40, other than the photomask used.

In the process just described, second layer 26 is supported not only by an outer peripheral region 66 of first layer 24, but also by the remaining segments 56 and 58 of each support pedestal 54. Therefore, the lengths of unsupported spans of second layer 26 are reduced, and the potential for second layer 26 to cave in on the open areas of first layer 24 are substantially minimized.

Figure 8:
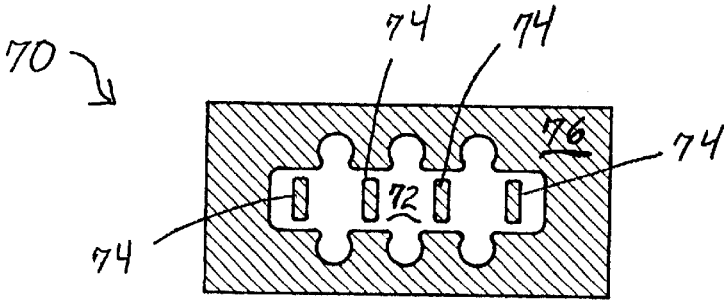
FIG. 8 is a top plan view of a photomask applied to an alternate photoresist layer for the heater chip shown in FIG. 7.

It should be readily understood that, while a negative photoresist material and appropriate process has been described, a so-called "positive" photoresist material and appropriate processing could also be used. When positive photoresist material is used, an appropriate photomask will cover areas intended to remain after processing, as a positive photoresist material results in the removal of exposed photoresist material and the hardening of covered photoresist material. Thus, an appropriate photomask for positive photoresist will leave areas for the ink conducting voids exposed, and will cover areas to be hardened as support surfaces for second layer 26. FIG. 8 illustrates an appropriate photomask 70 that can be used in place of photomask 42 when a positive photoresist material used. Photomask 70 includes a translucent area 72, opaque areas 74 for pedestals 54 and an outer opaque area 76 for outer peripheral support area 66.

It should also be recognized that numerous types or forms of negative or positive photoresist or other imageable material can be used. Thus, a photoresist material may be applied by lamination of a dry film photoresist material, by spin coating of liquid form photoresist, or by any other suitable application method. The application process also includes additional steps well-known to those skilled in the art, such as cleaning and drying of substrate 22 before the application of unprocessed photoresist layer 40, and cleaning and drying first layer 24 before completing the formation of second layer 26, which steps have not been described herein. Imageable materials that may be activated by other than photosensitive processes also can be used, as will be understood readily by those familiar with the art.

As an alternative to grit blasting for forming ink via 30, wet or dry micromachining, laser ablation or another suitable procedure can also be used to create via 30 through the support structure, including semiconductor substrate 22 and first layer 24. Either micromachining or laser ablation yield highly accurate formation of ink vias, such that a plurality of small holes can be etched or ablated into the via area. Thus, more complicated support structures than that described for FIGS. 1–5 can be formed. The more intricate support structures can be used as an internal filter to prevent hardened particles or contamination in the ink supply from reaching firing chambers 34, and subsequently plugging nozzles 28. Such contamination instead can be trapped within the support matrix.

Figure 6:
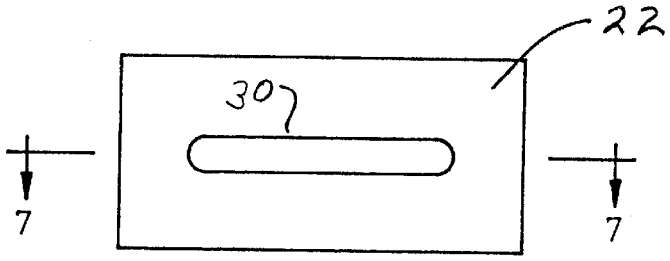
FIG. 6 is a plan view of a heater chip, with an ink via having been formed therein during an early stage of a second embodiment of the manufacturing process according to the present invention.
Figure 7:
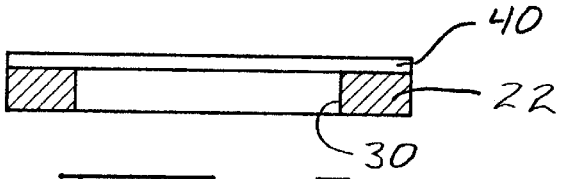
FIG. 7 is a cross-sectional view of the heater chip shown in FIG. 6, taken along line 7—7 of FIG. 6, but at a later step in the manufacturing process.
Figure 9:
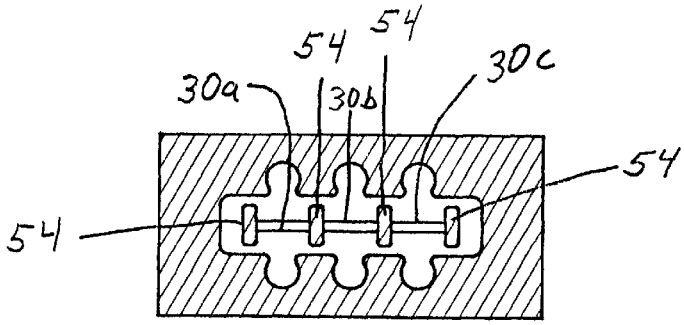
FIG. 9 is a top plan view similar to that shown in FIG. 8, after a further manufacturing step, and with the photomask having been removed.

A second alternative for the manufacturing process is illustrated in FIGS. 6, 7 and 9. In the alternative process, ink via 30 is first created in substrate 22, prior to the application of the imageable materials. Substrate 22, having ink via 30 therein, is shown in FIG. 6. Again, ink via 30 may be created by grit blasting, micromachining, laser ablation or other suitable process.

After the creation of ink via 30, first layer 24 of imageable material is created by laminating unprocessed photoresist or other imageable material layer 40 directly over substrate 22, including being applied over ink via 30. Again, an unprocessed imageable material layer 40 of photoresist may be applied by lamination of a dry film, or other suitable application technique. A cross-sectional view of substrate 22 with unprocessed photoresist layer 40 thereon is shown in FIG. 7. Again, photomask 42 is applied to unprocessed photoresist layer 40, and if negative photoresist is used, the photoresist is subsequently processed such that unmasked areas are hardened and remain, whereas photomasked areas remain unhardened. After completing the processing of first layer 24, including removal of unhardened photoresist from layer 40, second layer 26 is applied thereover and photomasked as necessary to define nozzles 28. Subsequent processing of second layer 26 is completed in known, conventional form.

FIG. 9 illustrates the structure, in a view similar to that of FIG. 3, after completing processing of first layer 24 and before the application of second layer 26. By creating ink via 30 before the application and processing of first layer 24, the subsequent support pedestals 54 remain intact, spanning ink via 30. Thus, rather than supplying a continuous elongated opening along the entire length of ink via 30, with pedestal segments 56 and 58 of each pedestal 54 up to the edge of via 30, four support pedestals 54 are unsegmented, remaining full length, spanning via 30 and effectively dividing the opening of ink via 30 into three ink via segments 30*a*, 30*b* and 30*c*. Separate segments 30*a*, 30*b* and 30*c* of ink via 30 communicate with the various ink conducting voids in first layer 24. However, added support is provided for second layer 26, since support pedestals 54 are uninterrupted, and span ink via 30.

Figure 10:
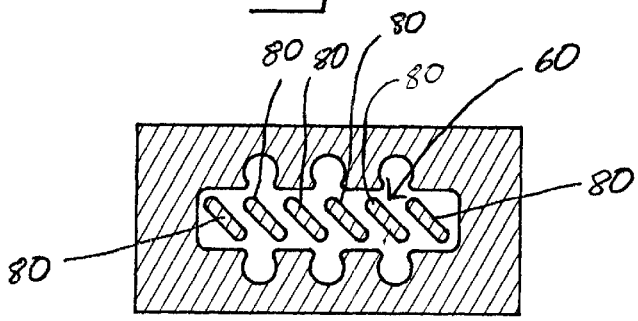
FIG. 10 is a top plan view, similar to FIG. 3, but illustrating a modified first photoresist layer in accordance with the present invention.

The present methods allow for more complicated formation of supporting structures. As illustrated in FIG. 10, support matrix 60 includes a plurality of angular support pedestals 80. Angular support pedestals 80 may be created in conjunction with either of the aforementioned manufacturing methods, such that angular support pedestals 80 completely span previously created ink via 30, or the ink vias may be created after the formation of angular support pedestals 80 such that pedestal segments similar to pedestal segments 56 and 58 are provided up to the edge of the ink via, without spanning the ink via.

Figure 11:
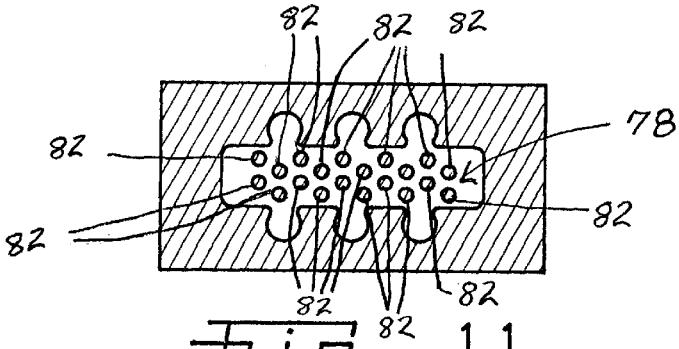
FIG. 11 is a top plan view of another modified first photoresist layer in accordance with the present invention.
Figure 12:
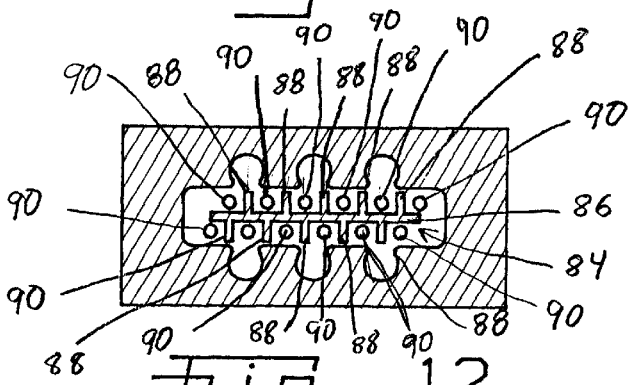
FIG. 12 is a top plan view of yet another first photoresist layer in accordance with the present invention.

FIG. 11 illustrates yet another support matrix 78 in which a plurality of support posts 82 are provided. In FIG. 12, a complex support matrix 84 is illustrated, and includes an elongated central wall 86, with laterally extending support legs 88 extending outwardly from central wall 86. Again, either positive or negative photoresist may be used with the suitable photomask therefore. Rather than an elongated ink via, a plurality of mini ink vias 90 is provided. Mini vias 90 are in the form of cylindrical, square or rectangular openings through substrate 22.

Figure 13:
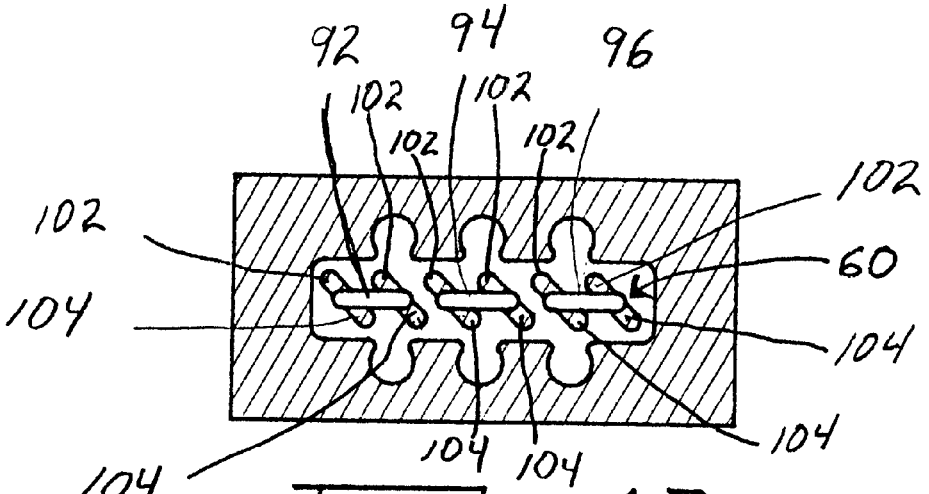
FIG. 13 is a top plan view of still another first photoresist layer in accordance with the present invention.

FIG. 13 illustrates yet another possible structure in which a plurality of smaller, yet elongated ink vias is provided. Three such ink vias 92, 94 and 96 are shown in FIG. 13, together with a plurality of angular support pedestals 80 which have been segmented into support pedestal segments 102 and 104, ink vias 92, 94 and 96 having been formed after the formation of first layer 24.

The present invention provides an imageable support matrix for printhead nozzle plates, and a method for the manufacture thereof, which utilizes known materials, techniques and processes. The support matrix provides additional support for the nozzle plate, reducing the length of unsupported spans, and reducing the potential for the nozzle plate to collapse over along the unsupported spans.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of forming an ink jet printhead comprising:

providing a substrate;

creating an ink via in said substrate by removing material from said substrate;

applying a first layer of imageable material on said substrate including applying said imageable material over said ink via;

masking the applied first layer of imageable material;

developing said first layer of imageable material to provide ink-conducting voids in said first layer of imageable material and openings through said first layer of imageable material communicating with said ink via;

applying a second layer of imageable material on said first layer of imageable material; and forming nozzles in said second layer of imageable material.

2. The method of claim 1, said step of creating an ink via performed by laser ablation.

3. The method of claim 1, said step of creating an ink via performed by micromachining.

4. The method of claim 3, said step of creating an ink via performed by grit blasting.

5. The method of claim 1, said step of applying a first layer of imageable material performed by laminating a dry film of imageable material.

6. The method of claim 1, said step of applying a second layer of imageable material performed by laminating a dry film of imageable material.

7. The method of claim 6, said step of applying a first layer of imageable material performed by laminating a dry film of imageable material.

8. The method of claim 1, selecting said first layer of imageable material from positive imageable material and negative imageable material.

9. The method of claim 1 said step of applying a first layer of imageable material performed by spin coating liquid imageable material.

10. The method of claim 9, said step of applying a second layer of imageable material performed by laminating a dry film of imageable material.

11. The method of claim 1, imageable material for said step of applying a first layer of imageable material and for said step of applying a second layer of imageable material selected from photosensitive materials including positive photoresist and negative photoresist.

* * * * *

UNITED STATES PATENT AND TRADEMARK OFFICE

CERTIFICATE OF CORRECTION

PATENT NO. : 6,684,504 B2
DATED : February 3, 2004
INVENTOR(S) : Carl Edmond Sullivan et al.

It is certified that error appears in the above-identified patent and that said Letters Patent is hereby corrected as shown below:

Column 10,
Line 16, insert -- including -- before “selecting”.

Signed and Sealed this

Twenty-seventh Day of April, 2004

JON W. DUDAS
*Acting Director of the United States Patent and Trademark Office*